US008511528B2

(12) United States Patent
Oiwa et al.

(10) Patent No.: US 8,511,528 B2
(45) Date of Patent: Aug. 20, 2013

(54) COMBUSTION POWER TOOL

(75) Inventors: Norio Oiwa, Nagoya (JP); Yoichiro Koike, Anjo (JP); Makoto Takahashi, Anjo (JP); Kenichi Miyata, Anjo (JP)

(73) Assignee: Makita Corporation, Anjo-Shi (JP)

( * ) Notice: Subject to any disclaimer, the term of this patent is extended or adjusted under 35 U.S.C. 154(b) by 383 days.

(21) Appl. No.: 12/896,320

(22) Filed: Oct. 1, 2010

(65) Prior Publication Data

US 2011/0079624 A1 Apr. 7, 2011

(30) Foreign Application Priority Data

Oct. 7, 2009 (JP) ..... 2009-233339

(51) Int. Cl.
*B25C 1/08* (2006.01)

(52) U.S. Cl.
USPC ..... 227/9; 227/8; 227/10; 123/46 A; 123/262; 123/286

(58) Field of Classification Search
USPC ..... 227/8, 10, 9; 123/46 A, 262, 263, 123/286, 46 R
See application file for complete search history.

(56) References Cited

U.S. PATENT DOCUMENTS 1,644,517 A * 10/1927 Eiermann ..... 123/262
6,779,493 B2 * 8/2004 Doherty et al. ..... 123/24 A
6,964,553 B2 * 11/2005 Ricordi ..... 415/146
7,243,829 B2 7/2007 Oda et al.
2001/0006045 A1 * 7/2001 Thieleke et al. ..... 123/46 R
2002/0134345 A1 * 9/2002 Adams ..... 123/285
2004/0144357 A1 7/2004 Adams

FOREIGN PATENT DOCUMENTS

EP 1 484 138 A2 12/2004
JP 2004-358565 12/2004

OTHER PUBLICATIONS

Extended European Search Report issued in European Patent Application No. 10186731.5 mailed Oct. 22, 2012.

* cited by examiner

*Primary Examiner* — Michelle Lopez
(74) *Attorney, Agent, or Firm* — Oliff & Berridge, PLC

(57) ABSTRACT

A technique for improving the cooling performance of a combustion chamber in a combustion power tool is provided. The combustion power tool includes first and second combustion chambers, a partition that separates the first combustion chamber from the second combustion chamber, openings, formed in the partition and communicate the first combustion chamber with the second combustion chamber, and a drive section that moves toward a front end by combustion pressure. The combustion pressure is generated when a flow of flammable gas, which is produced by combustion of the flammable gas in the first combustion chamber propagates to the second combustion chamber through the openings, and burns flammable gas in the second combustion chamber. The combustion gas flows from the first combustion chamber to the second combustion chamber in a direction around a central axis of the second combustion chamber while flowing along an inner wall of the second combustion chamber.

4 Claims, 5 Drawing Sheets

COMBUSTION POWER TOOL

BACKGROUND OF THE INVENTION

1. Field of the Invention

The invention relates to a combustion power tool that performs a predetermined operation by utilizing a high pressure impact force generated upon combustion of flammable gas.

2. Description of the Related Art

Japanese non-examined laid-open Patent Publication No. 2004-358565 discloses a combustion power tool such as a nailing machine and a tacker, which is powered by a piston/cylinder-type internal combustion engine. In this known art, a combustion chamber is partitioned into a main combustion chamber and a secondary combustion chamber by a partition having communication holes. Combustion gas is burned in the secondary combustion chamber and then led into the main combustion chamber, so that flammable gas within the main combustion chamber is burned. By combustion pressure generated by this burning action, a piston member is moved to a front end side, so that a nail driving operation is performed on a workpiece.

In the above-described combustion power tool, after nail driving movement of the piston member, gas within the main combustion chamber is cooled so that pressure within the main combustion chamber is reduced to below atmospheric pressure (to a negative pressure). As a result, the piston member is returned to its initial position. Therefore, in such a construction, in order to reliably return the piston member to its initial position after nail driving movement, it is important to reduce the gas temperature within the combustion chamber. In this known combustion power tool, further improvement is required in cooling the gas within the main combustion chamber after nail driving movement of the piston member.

SUMMARY OF THE INVENTION

Accordingly, it is an object of the invention to improve cooling performance of a combustion chamber within a combustion power tool.

Above-described object can be achieved by the claimed invention. According to the invention, a representative combustion power tool has first and second combustion chambers, a partition and a drive section.

The first and second combustion chambers are filled with flammable gas. The partition separates the first combustion chamber from the second combustion chamber. A plurality of combustion chambers may be suitably used in such a manner that the first combustion chamber is used as a region for igniting mixed gas and the second combustion chamber is used as a region for obtaining high combustion energy required for nailing operation.

Openings are formed in the partition in the invention. The first combustion chamber communicates with the second combustion chamber via the openings. In this invention, a combustion gas flow caused by combustion of flammable gas in the first combustion chamber propagates to the second combustion chamber through the openings and burns flammable gas in the second combustion chamber. The drive section in the invention is caused to move toward a front end by combustion pressure generated by such burning action and performs a predetermined operation. The "predetermined operation" typically represents an operation using a power tool (such as a nailing machine) for driving nails, staples or the like into a workpiece. The "opening" not only includes an opening flush with an outer surface of the partition (interface between the partition and the second combustion chamber), but it also suitably includes an opening (nozzle) protruding from the outer surface of the partition toward the second combustion chamber. Further, the "opening" in terms of the shape suitably includes circular or other holes and slits extending in the circumferential direction of the second combustion chamber or in the direction of the central axis of the second combustion chamber.

The combustion gas flows from the first combustion chamber to the second combustion chamber in a direction around a central axis of the second combustion chamber while flowing along an inner wall of the second combustion chamber. The "flow in a direction around an central axis" here represents the flow of the combustion gas to the second combustion chamber which flows in the circumferential direction while flowing along the inner wall of the second combustion chamber, and it also preferably includes the circumferential flow having components in the direction of the central axis. When the drive section is caused to move toward the front end by the combustion pressure within the second combustion chamber and a predetermined operation is performed, the gas temperature within the second combustion chamber is cooled by expansion of gas which is caused by movement of the drive section toward the front end and by a cooling action via the wall of the second combustion chamber. In this manner, the gas temperature within the second combustion chamber is reduced and thus the pressure is reduced. Then, when the pressure of the second combustion chamber is reduced to below atmospheric pressure (to a negative pressure), the drive section is returned to its initial position in which it is not yet moved by combustion pressure.

With such construction, the combustion gas flows from the first combustion chamber to the second combustion chamber in the circumferential direction while flowing along the inner wall of the second combustion chamber. Such a circumferential flow diffuses gas within the second combustion chamber. Therefore, after operation of the drive section, the combustion gas within the second combustion chamber actively comes in contact with the wall surrounding the combustion gas, so that the cooling of gas within the combustion chamber is accelerated. As a result, the pressure of the second combustion is reduced to a negative pressure, so that the drive section is reliably returned to its initial position.

According to a further aspect of the invention, the partition has first openings through which the gas flowing from the first combustion chamber to the second combustion chamber forms an axial flow in the direction of the central axis of the second combustion chamber and second openings through which the gas forms a swirl flow in a direction around the central axis. The "axial flow" here suitably includes a linear flow along the axial direction and a flow having radial components. Further, the "swirl flow" suitably includes a flow having components in the direction of the central axis.

With such construction, when flammable gas is charged into the second combustion chamber, mixture of the flammable gas or mixture of fuel and air is efficiently made by the axial flow from the first combustion chamber to the second combustion chamber through the first openings. Therefore, when flammable gas within the first combustion chamber is burned, a combustion gas flow efficiently propagates from the first combustion chamber to the second combustion chamber, so that the combustibility of the gas within the second combustion chamber can be improved. Further, the swirl flow is produced along the inner wall of the second combustion chamber by the flow of combustion gas from the first combustion chamber to the second combustion chamber through the second openings. After operation of the drive section, gas within the second combustion chamber is actively cooled by the swirl flow, so that the pressure reduction within the second combustion chamber can be accelerated.

According to a further aspect of the invention, the combustion power tool further includes an igniter disposed in the first combustion chamber, and the partition has at least one spherical portion centered on the igniter. With such a construction, when combustion gas filled in the first combustion chamber is burned, the burning front of the combustion gas in the first combustion chamber reaches the first and second openings substantially at the same time. Therefore, the flammable gas filled in the second combustion chamber is simultaneously and evenly ignited starting from the surrounding region of the partition. As a result, combustion energy within the second combustion chamber can be transmitted to the drive section side in a balanced manner. The "spherical portion" of the partition suitably includes not only a spherical portion having a uniform curvature in this part of the partition, but a spherical portion having a slightly un-uniform curvature or having an elliptical section.

According to a further aspect of the invention, the spherical portion has a surface extending in the direction of the central axis of the second combustion chamber, and the second openings for forming the swirl flow are formed in the surface. With such construction, the surface extending in the direction of the central axis of the second combustion chamber can be simultaneously formed, for example, when manufacturing the partition having the spherical portion. Therefore, openings such as holes or slits can be easily formed in the surface extending in the direction of the central axis. Compared with a construction, for example, in which a nozzle for forming a swirl flow is mounted as a separate member on the spherical portion, openings can be easily formed at lower costs.

According to a further aspect of the invention, at least a pair of second openings for forming the swirl flow are formed on both sides of the central axis of the second combustion chamber. With such construction, the swirl flow can be produced all over the inside of the second combustion chamber in the circumferential direction in a balanced manner.

According to the invention, the cooling performance of a combustion chamber in a combustion power tool can be improved. Other objects, features and advantages of the present invention will be readily understood after reading the following detailed description together with the accompanying drawings and the claims.

DETAILED DESCRIPTION OF THE INVENTION

Each of the additional features and method steps disclosed above and below may be utilized separately or in conjunction with other features and method steps to provide and manufacture improved combustion power tool and method for using such combustion power tool and devices utilized therein. Representative examples of the present invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

Figure 1:
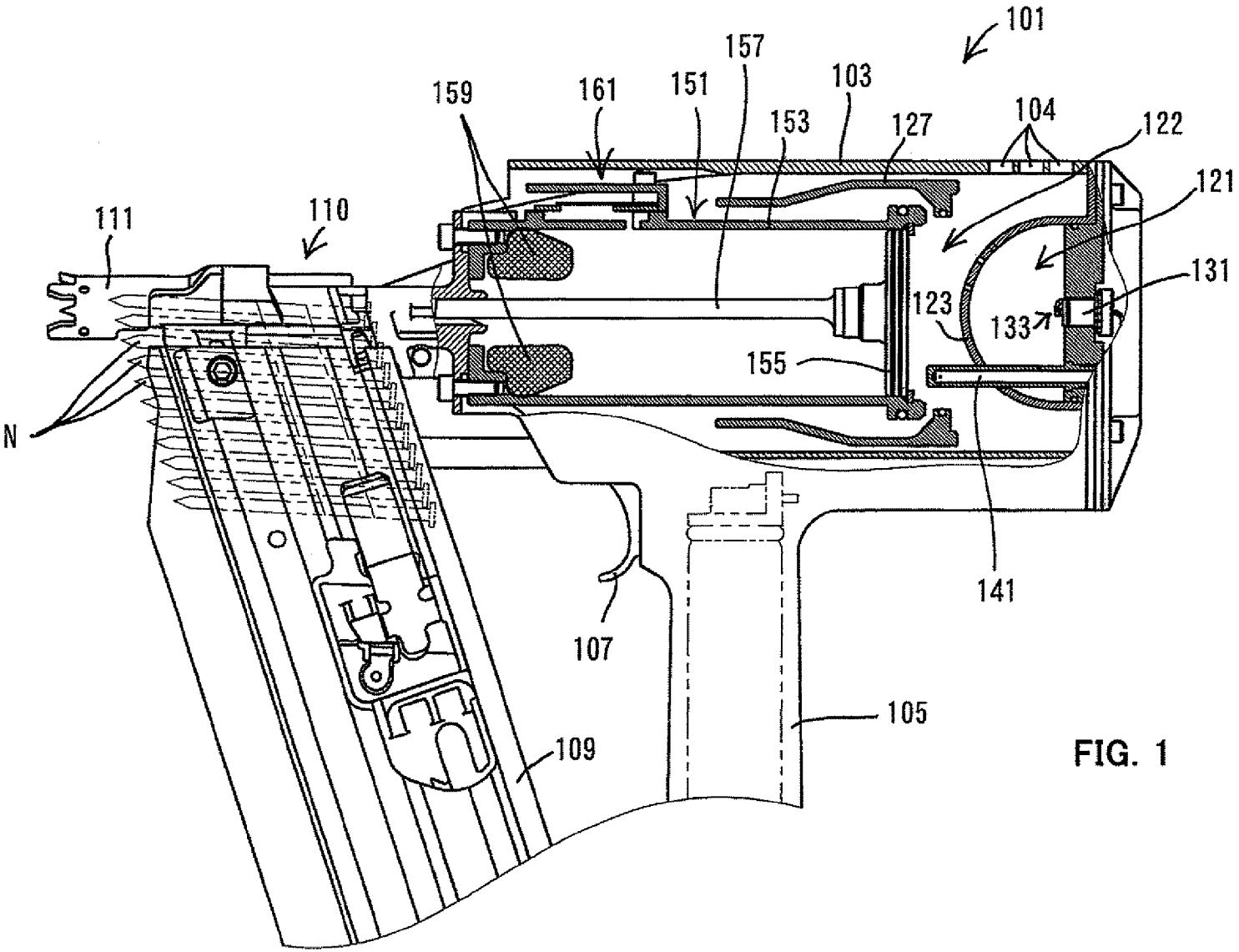
FIG. 1 is a front view, partly in section, showing an entire combustion nailing machine according to an embodiment of the invention.
Figure 2:
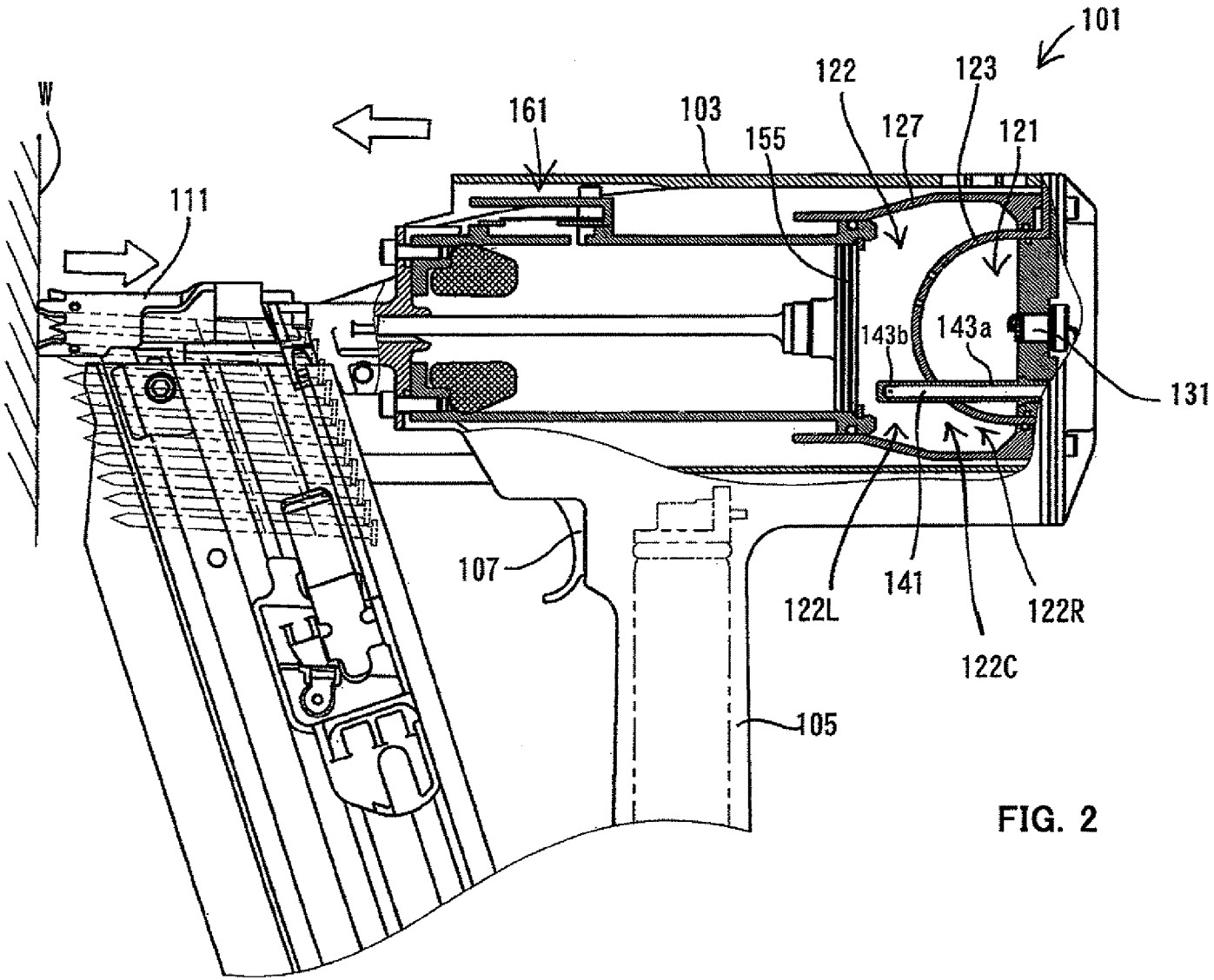
FIG. 2 shows the nailing machine according to this embodiment in the state of the instant when a trigger is depressed with the nailing machine pressed against a workpiece.
Figure 3:
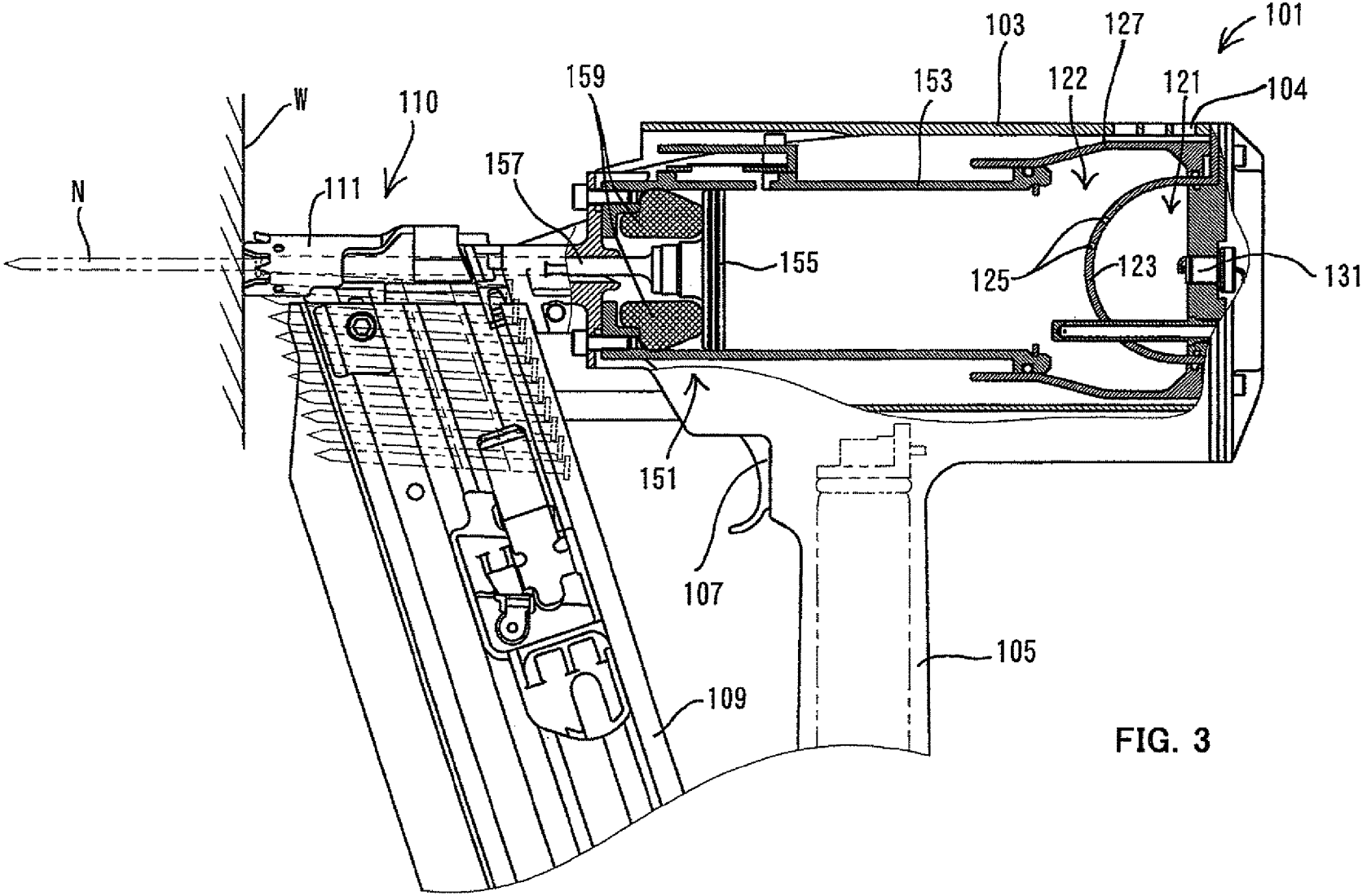
FIG. 3 shows the nailing machine in the state in which a drive section is actuated by a burning action in first and second combustion chambers and a nail is driven into the workpiece.

A representative embodiment of the invention is now described with reference to the drawings. As shown in FIGS. 1 to 3, a nailing machine 101 as a representative embodiment of the combustion power tool according to the invention includes a main housing 103, a nail ejection part 110, a handgrip 105 and a magazine 109. The main housing 103 houses a first combustion chamber 121, a second combustion chamber 122, an igniter 131, a fuel injector 141 and a drive section 151. Bleed holes 104 are formed in the main housing 103 near the first combustion chamber 121 and the second combustion chamber 122. The first and the second combustion chambers 121, 122 can communicate with the outside through the bleed holes 104.

The first combustion chamber 121 is defined by a partition 123 and a flat end wall surface 129. The partition 123 separates the first combustion chamber 121 from the second combustion chamber 122, and the end wall surface 129 is located on the side of the first combustion chamber 121 opposite from the second combustion chamber 122. In this embodiment, the first combustion chamber 121 is used as an area for igniting a mixture, which will be described below, while the second combustion chamber 122 is used as an area for obtaining high combustion energy required for nailing operation. The first combustion chamber 121, the second combustion chamber 122 and the partition 123 are features that correspond to the "first combustion chamber, the "second combustion chamber" and the "partition", respectively, according to this invention.

The partition 123 mainly comprises a spherical portion 124 having a generally hemispherical shape centered on an ignition part 133 of the igniter 131. The spherical portion 124 has a flange formed on its peripheral edge and protruding outward and the flange is secured to the end wall surface 129. Numerous circular first communication holes 125 and numerous circular second communication holes 128 (see FIGS. 4 and 5) are formed through the spherical portion 124. The gas flowing from the first combustion chamber 121 to the second combustion chamber 122 forms an axial flow having components in the direction of the central axes of the first and second combustion chambers 121, 122, by flowing through the first communication holes 125, while it forms a swirl flow around the central axes by flowing through the second communication holes 128 (see FIGS. 4 and 5). The first and second combustion chambers 121, 122 communicate with each other through the communication holes 125, 128. The first communication holes 125 and the second communication holes 128 are features that correspond to the "first openings" and the "second openings", respectively, according to this invention. The central axes of the first and second combustion chambers 121, 122 coincide with each other.

Figure 4:
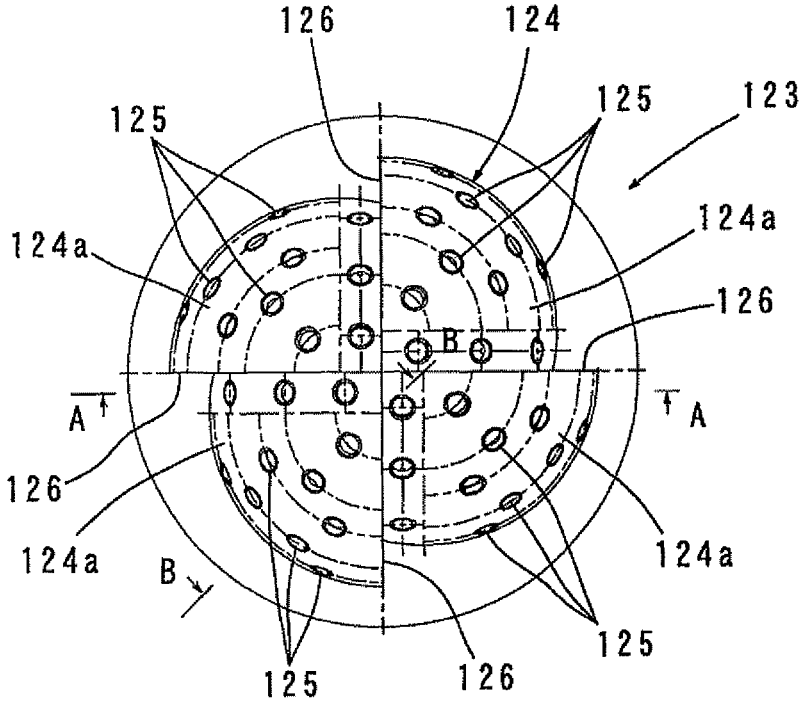
FIG. 4 shows a partition as viewed from the front end side (piston side).
Figure 6:
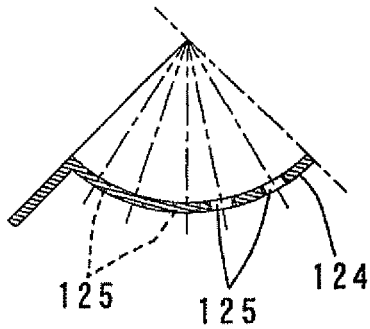
FIG. 6 is a sectional view taken along line B-B in FIG. 4.

As shown in FIG. 4, the first communication holes 125 are arranged in the spherical portion 124 at appropriate intervals from its central side (the bottom side of the spherical portion 124) to its peripheral edge side and in the circumferential direction. Specifically, the first communication holes 125 are systematically arranged over the spherical portion 124 and located at substantially the same distance from the ignition part 133. Further, as shown in FIGS. 1 and 6, a central axis of each of the first communication holes 125 extends generally toward the ignition part 133 of the igniter 131.

Figure 5:
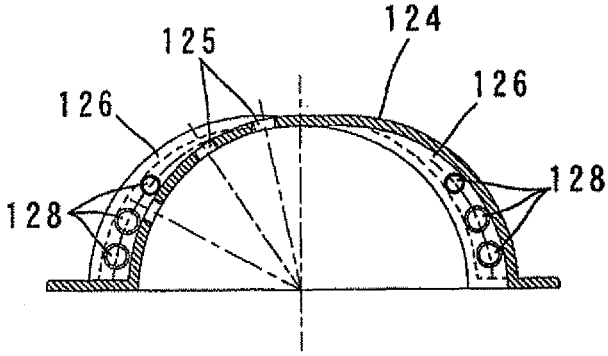
FIG. 5 is a sectional view taken along line A-A in FIG. 4.

As shown in FIG. 4, upright flat portions 126 are formed on the outer surface of the spherical portion 124 at locations to divide the spherical portion 124 into four equal parts in the circumferential direction and extend in a direction of the central axis of the second combustion chamber 122 as viewed from the side in a direction transverse to the central axis of the second combustion chamber 122. Each of the flat portions 126 has the second communication holes 128. As shown in FIG. 5, each of the flat portions 126 is formed as a stepped surface on the outer circumferential surface of the spherical portion 124 and extends into a curved form which is tapered from the peripheral edge to the center of the spherical portion 124. Specifically, the flat portion 126 is a flat stepped surface which is formed on the outer circumferential surface of the spherical portion 124 in the radial direction and connects a large-diameter region of the spherical portion 124 remoter from its spherical center and a small-diameter region nearer to the spherical center. In other words, assuming that the hemisphere of the spherical portion 124 of the partition 123 is further divided into four equal parts in the circumferential direction, the spherical portion 124 is shaped as if each of divided spherical portions 124*a* as assumed is displaced a predetermined distance radially outward of the dividing surface with respect to the center of the spherical portion 124 and connected with each other in this state. Therefore, in this embodiment, the outer surface of the divided spherical portion 124*a* has a spherical surface having an ununiform curvature with respect to the center of the spherical portion 124. The flat portion 126 is a feature that corresponds to the "surface extending in the direction of the central axis of the second combustion chamber" according to this invention.

A plurality of (three in this embodiment) second communication holes 128 are formed in each of the flat portions 126 and arranged at appropriate intervals in the extending direction of the flat portion 126. As shown in FIG. 5, each of the second communication holes 128 is arranged such that its central axis extends substantially perpendicularly to the surface of the flat portion 126.

As particularly shown in FIG. 2, the second combustion chamber 122 is defined as a space surrounded by a piston 155 that forms the drive section, a slide sleeve 127 and the partition 123. Although it is not particularly shown, the slide sleeve 127 is normally biased toward a contact arm 111. Thus, the slide sleeve 127 normally holds the first and the second combustion chambers 121, 122 in an opened state and allows the combustion chambers 121, 122 to communicate with the outside via the bleed holes 104. When the nailing machine 101 is pressed upon a workpiece W, the contact arm 111 retracts in a direction away from the workpiece W. At the same time, the slide sleeve 127 closes the second combustion chamber 122. At this time, the first combustion chamber 121 is also cut off from communication with the outside. Specifically, the slide sleeve 127 functions as an element that forms a side wall surface of the second combustion chamber 122 and also as a means for controlling the opening and closing of the combustion chambers 121, 122 such that communication of the combustion chambers 121, 122 with the outside is allowed and prevented by the axial sliding movement of the nailing machine 101. The movement of the slide sleeve 127 during nailing operation is described below.

The second combustion chamber 122 is shaped like a barrel in the direction of its central axis. Specifically, as shown in FIG. 2, the second combustion chamber 122 includes an end region 122L on the piston 155 side, a central region 122C, and an end region 122R on the first combustion chamber 121 side, and the central region 122C is larger in the sectional area than the end regions 122L and 122R.

The igniter 131 comprises a spark plug. The ignition part 133 is disposed substantially in the center of the end wall surface 129 of the first combustion chamber 121 and substantially flush with the end wall surface 129. The igniter 131 is designed to perform ignition operation after a lapse of predetermined time from start of fuel injection of the fuel injector 141, which will be described below. Further, the igniter 131 is designed to perform electrical discharges several times in one ignition operation.

The fuel injector 141 forms a fuel supplying means and comprises a pipe-like member that extends from the first combustion chamber 121 into the second combustion chamber 122 through the partition 123. Further, a fuel injection hole 143*a* is formed through the fuel injector 141 at an appropriate point facing the first combustion chamber 121, and a fuel injection hole 143*b* is formed through the fuel injector 141 at an appropriate point facing the second combustion chamber 122. The fuel injector 141 is connected to a fuel tank, which is not shown, and receives a fuel supply. The amount of fuel injection by the fuel injector 141 is predetermined individually according to the effective capacity of the combustion chambers 121, 122.

As shown in FIG. 1, the drive section 151 mainly includes a cylinder 153 disposed within the main housing 103, the piston 155 that is slidably disposed within the cylinder 153, and a piston rod 157 integrally formed with the piston 155. Although it is not particularly shown, the front end of the piston rod 157 is connected to a nail ejecting device that is disposed within the nail ejection part 110 and serves to eject nails N forward. A cushion rubber 159 is appropriately disposed in a front end region within the cylinder 153 and serves to absorb and alleviate the impact of the piston 155 which is driven at high speed. Further, a non-return valve 161 is provided on the cylinder 153 and serves to communicate the bore of the cylinder 153 with the outside of the nailing machine 101. The non-return valve 161 is a one-way valve which allows fluid to flow out of the inside of the bore of the cylinder 153, but prevents fluid to flow into the bore of the cylinder 153 from the outside.

The magazine 109 is detachably mounted to the nail ejection part 110 formed on the front end of the main housing 103 of the nailing machine 101. The magazine 109 contains numerous nails N connected by a link and places a nail N to be driven next, into the ejection part 110. The construction of the magazine 109 itself is known and therefore its detailed description is omitted.

The contact arm 111 is mounted on the front end of the ejection part 110. The contact arm 111 can slide with respect to the ejection part 110 in the longitudinal direction of the ejection part 110 (the longitudinal direction of the nailing machine 101) and is normally biased to the front end side (leftward as viewed in FIG. 1) by a biasing means which is not shown. As shown in FIG. 2, when the user moves the nailing machine 101 toward the workpiece W with the contact arm 111 held in contact with the workpiece in order to drive the nails N into the workpiece W, the contact arm 111 relatively retracts with respect to the body 103 against the biasing force of the biasing means, while being held in contact with the workpiece. Upon such movement of the contact arm 111, the slide sleeve 127 also retracts and closes the first and the second combustion chambers 121, 122.

In order to perform a nailing operation by using the nailing machine 101 having the above-described construction, the user applies a pressing force toward the workpiece W upon the nailing machine 101 with the contact arm 111 being held in contact with the workpiece W as shown in FIG. 2. Then the contact arm 111 retracts with respect to the body 103 against the biasing force of the biasing means. The retracting movement of the contact arm 111 causes the slide sleeve 127 connected to the contact arm 111 to retract. As a result, the slide sleeve 127 closes the second combustion chamber 122 and cuts off the first and the second combustion chambers 121, 122 from communication with the outside. At this time, the first and the second combustion chambers 121, 122 are fully filled with air which flows in through the bleed holes 104 of the main housing 103 before they are cut off from communication with the outside.

In this state, when the user depresses a trigger 107 on the handgrip 105, fuel is injected into the combustion chambers 121, 122 through the fuel injection holes 143 of the fuel injector 141. The amount of fuel supply into the first and the second combustion chambers 121, 122 is set individually according to the capacity of each of the combustion chambers 121, 122. The injected fuel is mixed with the air within the combustion chambers 121, 122. Thus, the first and the second combustion chambers 121, 122 are fully filled with the mixture. The mixture is a feature that corresponds to the "flammable gas" in the invention.

Upon the ignition operation by the igniter 131, the mixture filled in the first combustion chamber 121 is ignited starting from the vicinity of the ignition part 133 and thus starts burning. The burning action of the mixture is explosive, and thus the burning front (flame front) of the mixture reaches the partition 123 in an extremely short time. In this embodiment, the partition 123 comprises the spherical portion 124 having a substantially constant radius from the ignition part 133. Thus, the burning front of the mixture originating from the ignition part 133 reaches the entire spherical portion 124 having a substantially constant radius from the ignition part 133, substantially at the same time. Therefore, ignition in the second combustion chamber 122 can be started simultaneously over the interface of the partition 123 through the communication holes 125. Thus, the timing of starting combustion in the second combustion chamber 122 can be effectively controlled.

Further, the central axis of any of the communication holes 125 formed in the partition 123 extends toward the ignition part 133. Therefore, when the burning front radially diffuses from the ignition part 133 in the first combustion chamber 121 and passes through the communication holes 125, its resistance can be minimized. In other words, the combustion pressure generated in the first combustion chamber 121 can be transmitted to the second combustion chamber 122 while loss of the combustion pressure is kept to a minimum.

Figure 7:
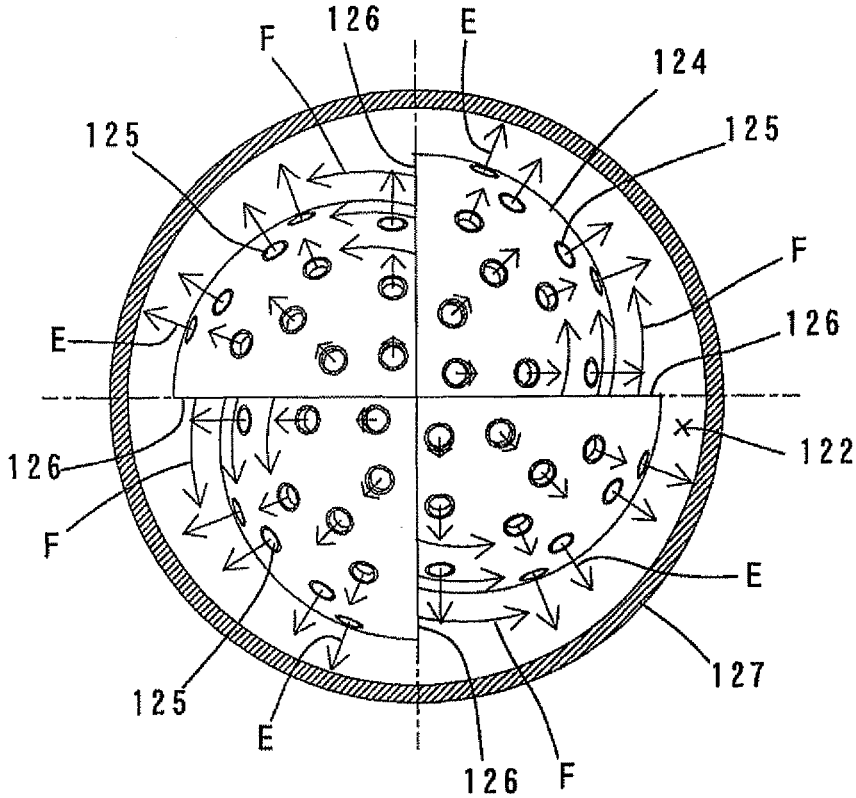
FIG. 7 shows the partition as viewed from the front end side (piston side) and illustrates the flow of combustion gas flowing through first and second communication holes.
Figure 8:
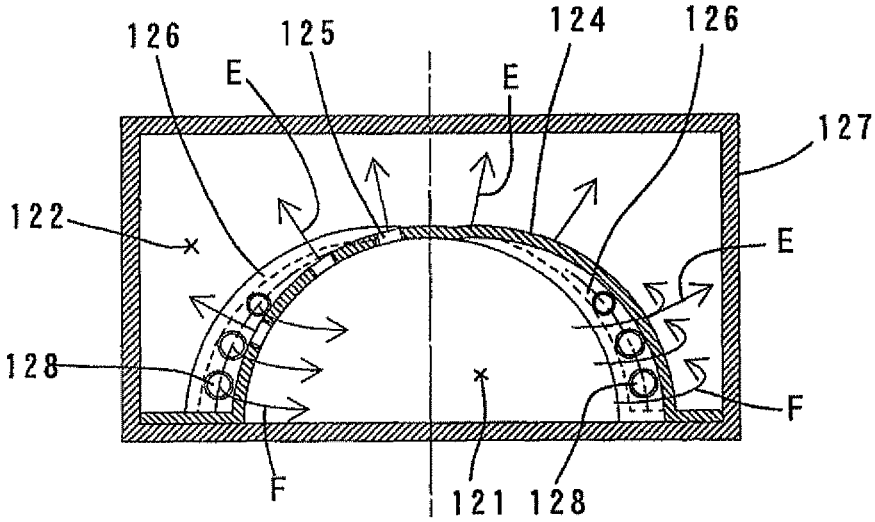
FIG. 8 is a view corresponding to FIG. 5 and illustrates the flow of combustion gas flowing through first and second communication holes.

Thus, the burning front formed in the first combustion chamber 121 reaches the first and second communication holes 125, 128 substantially at the same time, while radially diffusing from the ignition part 133. Then the burning front reaches the second combustion chamber 122, smoothly passing through the communication holes 125, 128. At this time, the mixture within the second combustion chamber 122 is ignited simultaneously starting from the entire surface region of the partition 123, and thus combustion of the mixture starts within the second combustion chamber 122. FIGS. 7 and 8 show flow of combustion gas flowing into the second combustion chamber 122 through the first and second communication holes 125, 128, by arrows. The gas flow through the first communication holes 125 is shown by the arrows E, and the gas flow through the second communication holes 128 is shown by the arrows F.

The second combustion chamber 122 has a larger capacity than the first combustion chamber 121, and a greater combustion pressure is generated by combustion of the mixture within the second combustion chamber 122. As mentioned above, the second combustion chamber 122 is configured such that the central region 122C has a larger sectional area than the end region 122L on the piston 155 side and the end region 122R on the first combustion chamber 121 side in the direction of the central axis of the second combustion chamber 122 (see FIG. 2). Therefore, the burning front of the mixture within the second combustion chamber 122 is ignited in the vicinity of the partition 123 and moves toward the drive section 151 along a gentle arc along the inner wall surface of the second combustion chamber 122 (i.e. the inner wall surface of the retracted slide sleeve 127). Thus, as shown in FIG. 2, the piston 155 slides toward the workpiece W within the cylinder 153 by the action of combustion energy of the mixture within the second combustion chamber 122 and by the action of combustion energy of the mixture within the first combustion chamber 121 which is introduced into the second combustion chamber 122 through the communication holes 125, 128.

When the piston 155 slides within the cylinder 153, the internal space of the cylinder 153 on the piston rod 157 side is reduced. However, such space reduction does not prevent the sliding movement of the piston 155 because air within the reduced space is allowed to escape to the outside via the non-return valve 161 (see FIG. 1).

When the piston 155 slides within the cylinder 153, the piston rod 157 moves linearly toward the workpiece W. As a result, as shown in FIG. 3, the nail N placed in the ejection part 110 is ejected at a high speed toward the workpiece W and driven into the workpiece W. At this time, the piston 155 moves at high speed toward the workpiece W within the cylinder 153 and abuts against the cushion rubber 159. The cushion rubber 159 absorbs and alleviates the kinetic energy of the piston 155, so that the piston 155 stops.

In the stage of completing the operation of driving the nail N, the combustion gas within the second combustion chamber 122 which has expanded due to the sliding movement of the cylinder 155 is cooled as a result of its expansion. As a result, a negative pressure is formed in the first and second combustion chambers 121, 122, so that a sucking action is caused. In this embodiment, combustion gas within the first combustion chamber 121 flows out through the second communication holes 128 formed in the flat portions 126 of the partition 123, in a direction along the wall surface of the second combustion chamber 122. Therefore, a circumferential flow or swirl flow (gas flow shown by the arrows F in FIGS. 7 and 8) is produced and actively cools the combustion gas. Thus, the pressure within the first and second combustion chambers 121, 122 is reduced to a negative pressure. As a result, the piston 155 automatically starts retracting in the direction away from the workpiece W. Thereafter, when the user stops applying the pressing force on the nailing machine toward the workpiece W, the contact arm 111 which has retracted relatively toward the main housing 103 moves forward (toward the workpiece W) by the biasing force of the biasing means. Upon such movement of the contact arm 111, the slide sleeve 127 moves forward (toward the cylinder 153). As a result, the first and the second combustion chambers 121, 122 are opened. Thus, the combustion chambers 121, 122 communicate with the outside of the nailing machine 101 via the bleed holes 104 of the main housing 103, so that the burned gas within the combustion chambers 121, 122 is discharged to the outside via the bleed holes 104. As a result, the nailing machine 101 returns to its initial state shown in FIG. 1.

According to this embodiment, the partition 123 comprises the spherical portion 124 having a substantially constant radius from the ignition part 133 of the igniter 131. Thus, the burning front of the mixture which is formed in the first combustion chamber 121 reaches the communication holes 125 of the partition 123 substantially at the same time, while radially diffusing toward the partition 123. Therefore, the flammable gas filled in the second combustion chamber 122 is simultaneously and evenly ignited starting from the entire circumferential surface region of the partition 123. Thus, the combustibility of the mixture within the second combustion chamber 122 (the main combustion chamber) can be improved, so that the nail-driving capability of the nailing machine 101 can be enhanced.

In the above-described nailing machine 101, after nail driving movement of the piston 151, gas within the second combustion chamber 122 is cooled so that pressure within the second combustion chamber 122 is reduced to below atmospheric pressure or a negative pressure is caused. As a result, the piston 155 is returned to its initial position. Therefore, in order to reliably return the piston 155 to the initial position after nail driving movement, it is important to reduce the gas temperature within the second combustion chamber 122.

In this embodiment, the spherical portion 124 has the flat portions 126 extending in the direction of the central axis of the second combustion chamber 122 (the direction of the central axis of the piston 155), and the flat portions 126 have the second communication holes 128 each of which has a central axis substantially perpendicular to the surface of the associated flat portion 126. Therefore, combustion gas burned in the first combustion chamber 121 flows out of the first combustion chamber 121 through the second communication holes 128 along a circumferential direction of the wall surface of the second combustion chamber 122. Thus, a swirl flow of the combustion gas is produced in the second combustion chamber 122. Therefore, after nail driving movement of the piston 151, the combustion gas within the second combustion chamber 122 actively comes into contact with the wall surfaces surrounding the combustion gas or the wall surfaces of the slide sleeve 127 and the cylinder 153, so that heat exchange is efficiently made via these wall surfaces. As a result, the cooling of gas within the second combustion chamber 122 is accelerated. Thus, according to this embodiment, the combustion gas within the second combustion chamber 122 can be actively cooled after nail driving movement, so that the return of the piston 155 to the initial position by a negative pressure within the second combustion chamber can be secured.

Further, in this embodiment, the flat portions 126 having the second communication holes 128 are integrally formed on the spherical portion 124. Therefore, compared with a construction, for example, in which a nozzle for forming a swirl flow is retrofitted on the spherical portion 124, manufacturing costs can be reduced. Further, according to this embodiment, the second communication holes 128 are formed at locations to divide the spherical portion 124 into four equal parts in the circumferential direction with respect to the central axis of the second combustion chamber. Therefore, the swirl flow can be produced all over the inside of the second combustion chamber in the circumferential direction in a balanced manner.

The invention is not limited to the embodiment as described above, but rather, may be appropriately changed or modified.

In this embodiment, the partition 123 is described as being shaped to have the spherical portion 124, but the shape of the spherical portion may be changed to a cylindrical box- or basket-like form.

Further, in this embodiment, four flat portions 126 (two pairs with respect to the central axis of the second combustion chamber 122) having the second communication holes 128 are described as being formed on the spherical portion 124, but the number of the flat portions 126 may be appropriately increased or decreased.

Further, the shape of the first and second communication holes 125, 128 are not limited to a circular shape, but they may be changed, for example, to slits extending in the circumferential direction or the direction of the central axis of the second combustion chamber 122.

Further, in this embodiment, the direction of the central axis of the second communication holes 128 for forming a swirl flow is designed to be a direction perpendicular to the central axis of the second combustion chamber 122 such that the swirl flow is produced in the horizontal direction around the central axis. The swirl flow may however be designed to be a swirl flow toward the piston 155 (spiral flow) or a flow having components in the direction of the central axis.

Further, in this embodiment, the nailing machine is described as a representative example, but the invention can be applied to a tacker for driving in staples.

DESCRIPTION OF NUMERALS

101 nailing machine (combustion power tool)
103 main housing
104 bleed hole
105 handgrip
107 trigger
109 magazine
110 nail ejection part
111 contact arm
121 first combustion chamber
122 second combustion chamber
123 partition
124 spherical portion
124*a* assumed divided spherical portion
125 first communication hole (first opening)
126 flat portion (surface extending in the direction of the central axis of the second combustion chamber)
127 slide sleeve
128 second communication hole (second opening)
129 end wall surface
131 igniter
133 ignition part
141 fuel injector
143 fuel injection hole
151 drive section

153 cylinder
155 piston
157 piston rod
159 cushion rubber
161 non-return valve
N nail
E gas flow through the first communication holes
F gas flow through the second communication holes

The invention claimed is:

1. A combustion power tool comprising:

first and second combustion chambers to which flammable gas is respectively filled, a partition that separates the first combustion chamber from the second combustion chamber, openings that are formed in the partition and serve to communicate the first combustion chamber with the second combustion chamber, and a drive section that is caused to move toward a front end by combustion pressure and performs a predetermined operation, the combustion pressure being generated when a combustion gas flow caused by combustion of flammable gas in the first combustion chamber propagates to the second combustion chamber through the openings and burns flammable gas in the second combustion chamber, wherein the combustion gas flows from the first combustion chamber to the second combustion chamber in a direction around a central axis of the second combustion chamber while flowing along an inner wall of the second combustion chamber, and the partition has a plurality of first openings through which the gas flowing from the first combustion chamber to the second combustion chamber forms an axial flow in the direction of the central axis of the second combustion chamber and a plurality of second openings through which the gas forms a swirl flow in a direction around the central axis.

2. The combustion power tool as defined in claim 1, further comprising an igniter disposed in the first combustion chamber, wherein the partition has at least one spherical portion centered on the igniter.

3. The combustion power tool as defined in claim 2, wherein the spherical portion has a surface extending in the direction of the central axis of the second combustion chamber, and the openings for forming a swirl flow are formed in the surface.

4. The combustion power tool as defined in claim 3, wherein at least a pair of openings for forming the swirl flow are formed on both sides of the central axis of the second combustion chamber.

* * * * *